US010619851B1

(12) United States Patent
Egger

(10) Patent No.: US 10,619,851 B1
(45) Date of Patent: Apr. 14, 2020

(54) AUTOMATIC CANDLE SNUFFER

(71) Applicant: Travis Egger, Parma, OH (US)

(72) Inventor: Travis Egger, Parma, OH (US)

( * ) Notice: Subject to any disclaimer, the term of this patent is extended or adjusted under 35 U.S.C. 154(b) by 78 days.

(21) Appl. No.: 16/135,295

(22) Filed: Sep. 19, 2018

(51) Int. Cl.
*F23Q 25/00* (2006.01)
*F21V 35/00* (2006.01)
*F21V 25/00* (2006.01)

(52) U.S. Cl.
CPC ..... *F23Q 25/00* (2013.01); *F21V 25/00* (2013.01); *F21V 35/00* (2013.01)

(58) Field of Classification Search
CPC ..... F23Q 25/00; F21V 25/00; F21V 35/00
USPC ..... 431/144
See application file for complete search history.

(56) References Cited

U.S. PATENT DOCUMENTS 763,440 A * 6/1904 Stevenson ..... F21V 35/00 431/35
886,198 A * 4/1908 Findlay ..... F23Q 25/00 431/35
1,101,296 A * 6/1914 Liaci ..... F23Q 25/00 431/35
1,308,215 A 7/1919 Baird
1,388,504 A * 8/1921 Baker ..... F23Q 9/02 431/33
3,885,905 A 5/1975 Giangiulio
4,138,211 A 2/1979 Kampfer
4,496,307 A 1/1985 Ginardi
D305,264 S 12/1989 Bengtsson et al.
4,887,960 A 12/1989 Stewart et al.
5,944,505 A 8/1999 Kroecher
6,345,978 B1 * 2/2002 Lu ..... F21L 17/00 431/152
6,494,708 B1 * 12/2002 Hart ..... F21V 35/00 431/146
6,572,365 B1 * 6/2003 Byxbe ..... F23Q 25/00 431/289
7,198,484 B2 * 4/2007 Hart ..... F21V 35/00 431/146
8,029,272 B1 * 10/2011 Kunkle ..... F23Q 25/00 33/289
8,469,701 B2 * 6/2013 Quinn ..... F23D 3/16 215/235
10,203,113 B2 * 2/2019 Yang ..... F21V 35/00
10,330,317 B2 * 6/2019 Chow ..... F23D 3/18
2007/0031769 A1 * 2/2007 Burton ..... F23Q 25/00 431/144
2007/0184395 A1 * 8/2007 Taylor ..... F23D 3/16 431/33
2019/0086076 A1 * 3/2019 Woodruff ..... F23D 3/32

* cited by examiner

*Primary Examiner* — Edelmira Bosques
*Assistant Examiner* — Nikhil P Mashruwala
(74) *Attorney, Agent, or Firm* — Cramer Patent & Design, PLLC; Aaron R. Cramer

(57) ABSTRACT

An automatic candle snuffing device comprises a lid hingedly secured to a support arm which in turn is removably secured about the circumference of a candle container. The lid is removably attached to the support arm, opposite a hinge, by a retention mechanism. Upon reaching a selected pre-set time as inputted to the timing device, the timing device activates the retention mechanism to release the lid in order to at least partially cover the candle opening and extinguishing a flame of the candle.

10 Claims, 10 Drawing Sheets

AUTOMATIC CANDLE SNUFFER

RELATED APPLICATIONS

Non-applicable.

FIELD OF THE INVENTION

The presently disclosed subject matter is directed to automatic candle snuffers.

BACKGROUND OF THE INVENTION

As anyone who has ever walked into a store or home where candles were being burned will attest, the aroma is very pleasant. It provides a comfortable, welcoming, feeling while at the same time masking any undesired odors. Unfortunately, since candles require the use of an open flame, they represent a significant safety risk as well.

Many people fall asleep without realizing a candle has remain lit, which may burn down and cause a fire. Even if a fire does not result, carbon monoxide remains a concern, especially in small places with no fresh air or air movement. Also, unlike many heating appliances, candles do not have an automatic timer or overtemperature cutoff that many of us have come to rely upon for our safety. Accordingly, there exists a need for a means by which candles can be automatically and safely extinguished to address the concerns as described above. The development of the Automatic Candle Snuffer fulfills this need.

SUMMARY OF THE INVENTION

The principles of the present invention provide for a candle snuffer comprising a strap which has a strap first end and a strap second end, a first fastener secured which is secured to the strap first end, a second fastener which is secured to the strap second end, a timing device having a power source which is secured to the strap between the strap first end and the strap second end, a post having an interior void and a plate. The post comprises a post first end, a post middle portion and a post second end opposite the post first end. The post first end is perpendicularly secured behind the timing device. The plate comprises a plate first end and a plate second end which is opposite the plate first end. The plate first end is hingedly secured to the post middle portion. The plate second end is temporarily secured to the post second end by a first magnet which is secured to the post second end and a second magnet which is secured to the plate second end, the first magnet being attracted to the second magnet.

The first fastener and the second fastener are configured to removably secure the candle snuffer about a circumference of a receptacle having a topside opening. The first magnet is an electric magnet. The timing device is in electrical communication with the first magnet. The timing device is configured to selectably designate a period of time for which to energize the first magnet. Upon an expiration of a period of time, the timing device de-energizes the first magnet necessitating the plate to fall from a vertical position to a horizontal position. When in the horizontal position, the plate covers the topside opening of the receptacle and wherein a burning candle contained within the receptacle is extinguished when the plate is in the horizontal position.

The first fastener and the second fastener may comprise hook and loop material while the timing device may comprise a timing device housing defining an interior and containing a programable microprocessor which is in communication with the power source within the interior. The timing device may further comprise a plurality of switches which are disposed upon an outer surface of the timing device housing and are in electrical communication with the microprocessor.

The plurality of switches permits a user to set a start time and a stop time relating to electrification of the first magnet. The power source may comprise traditional alternating current. The plate may further comprise a pair of hinge arms and a pin. Each hinge arm is secured to the plate at a respective hinge arm first end and around the post at a respective hinge arm second end. The pin is secured through each the hinge arm second end and the post.

The candle snuffer may also comprise an offset bracket which may be L-shaped having a first bracket arm and a second bracket arm perpendicular to the first bracket arm. The first bracket arm may be secured behind the second magnet and the second bracket arm may cover the first magnet and the second magnet when the plate is in the vertical position.

In a separate embodiment, the plate second end is temporarily secured to the post second end by a hook which is moveably secured partially within the post second end and an eyelet secured to the plate second end. The distal end of the hook is configured to rest within the eyelet. In this embodiment, the snuffer may also comprise a striker plate and a spring. A portion of the hook resides within the post. The striker plate is secured to the portion of the hook residing within the post while the spring is secured to the striker plate. When the spring is in a relaxed state the hook is disengaged from the eyelet. When a solenoid adjacent the striker plate and within the post is activated, the solenoid secures the striker plate in a position which keeps the spring in taut state. When in the taut state, the hook is capable of engaging the eyelet.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
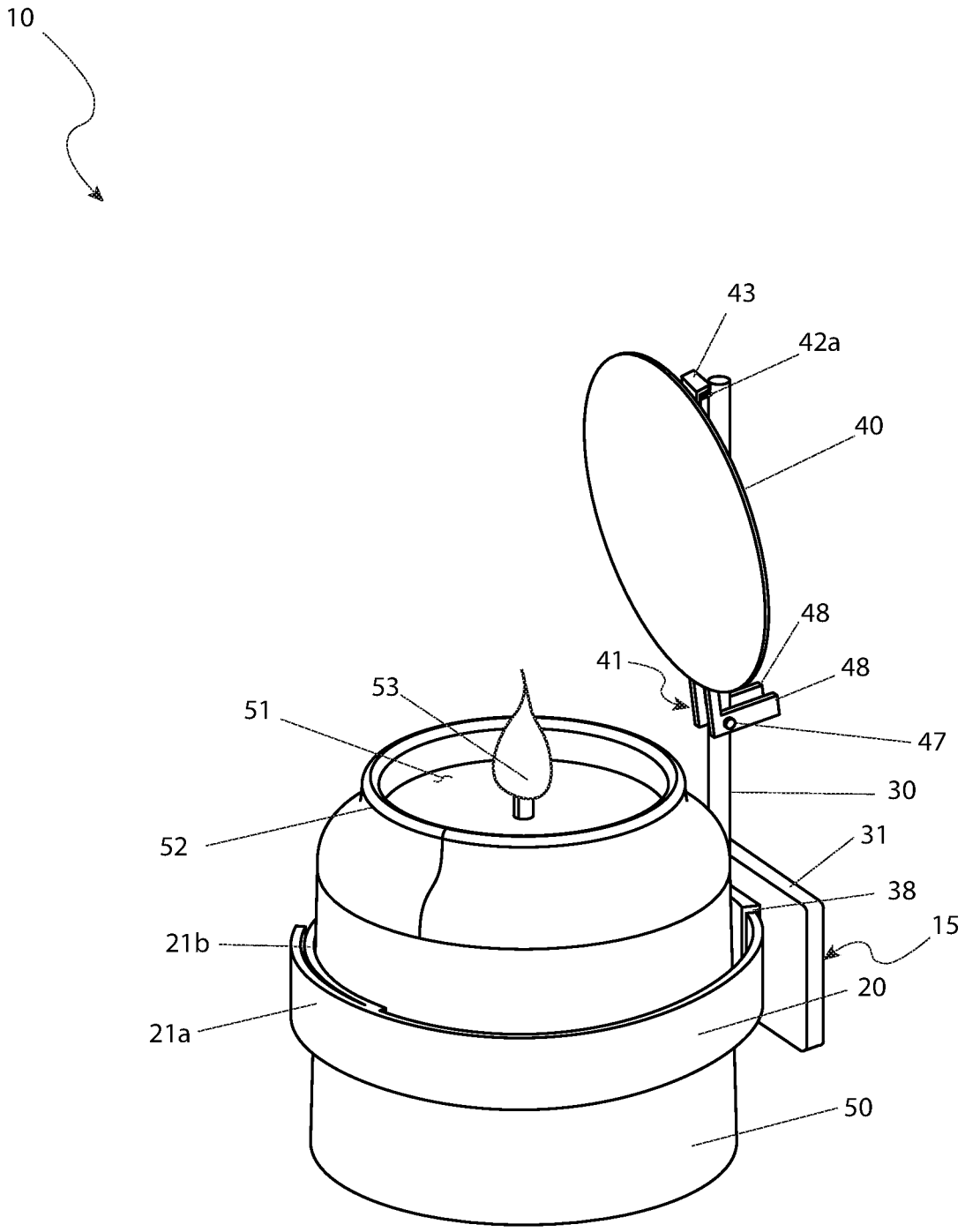
FIG. 1 is an environmental rear perspective view of the automatic candle snuffer 10, according to the preferred embodiment of the present invention.
Figure 2:
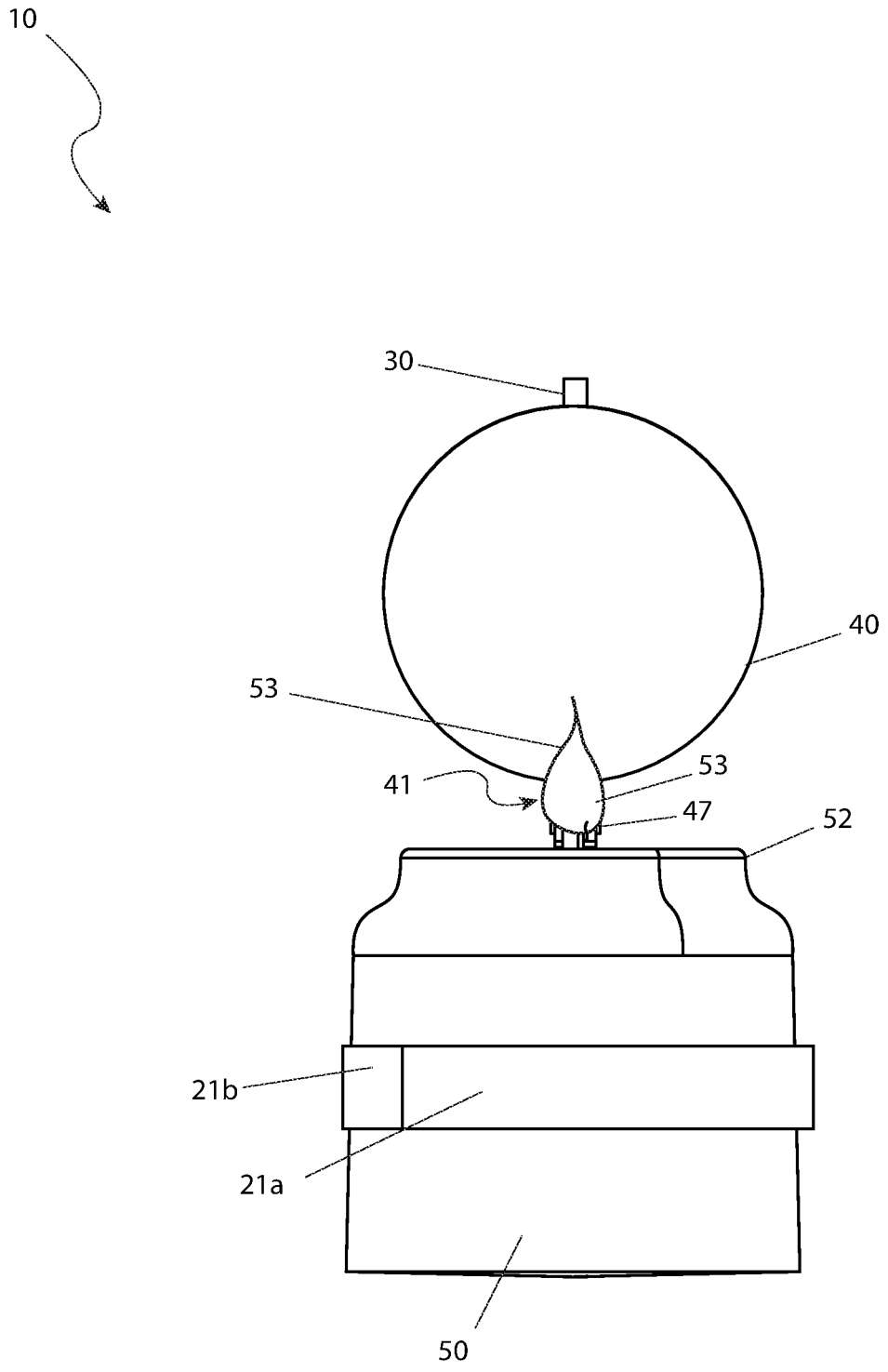
FIG. 2 is an environmental rear elevation view of the automatic candle snuffer 10, according to the preferred embodiment of the present invention.
Figure 3:
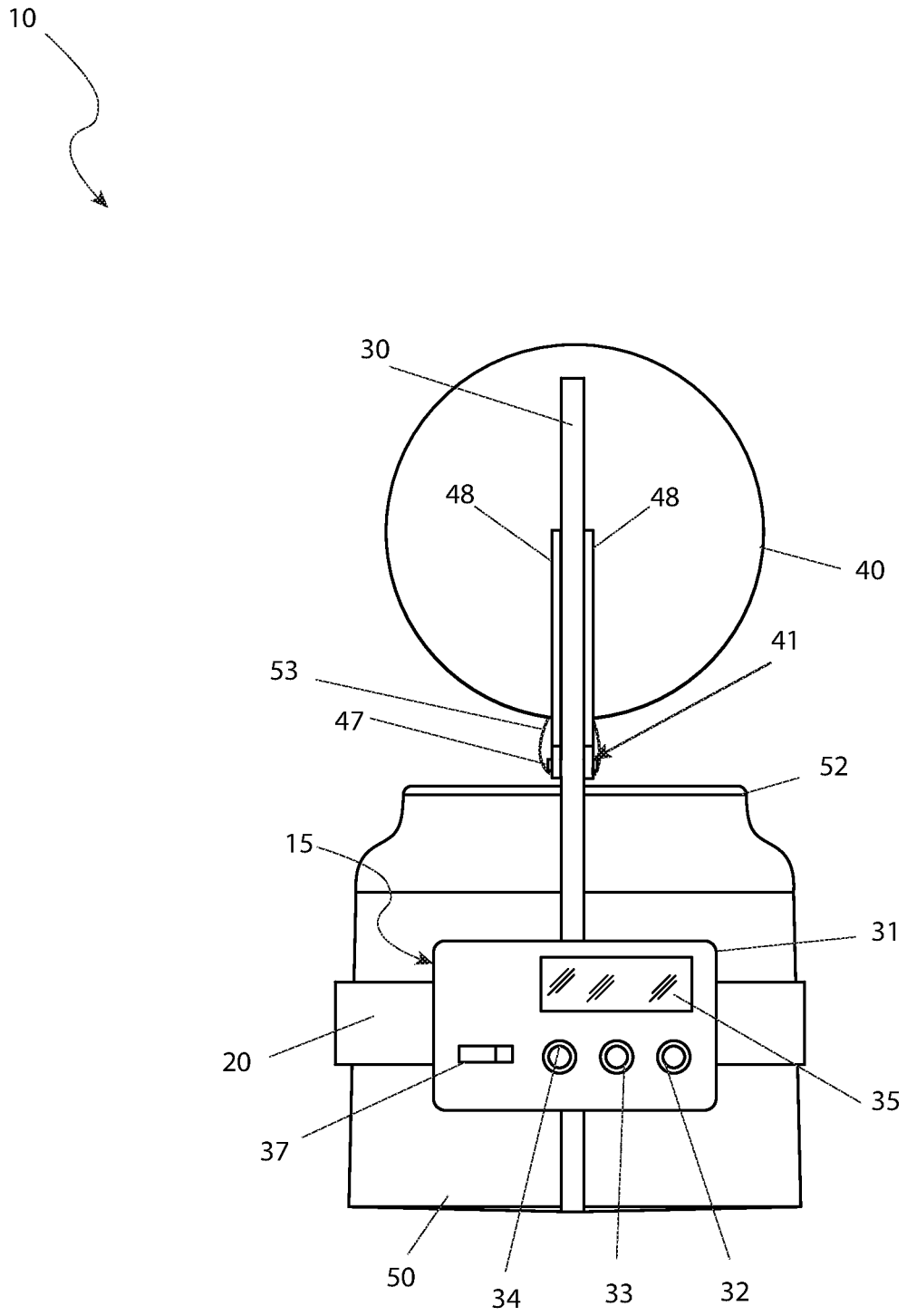
FIG. 3 is an environmental front elevation view of the automatic candle snuffer 10, according to the preferred embodiment of the present invention.
Figure 4:
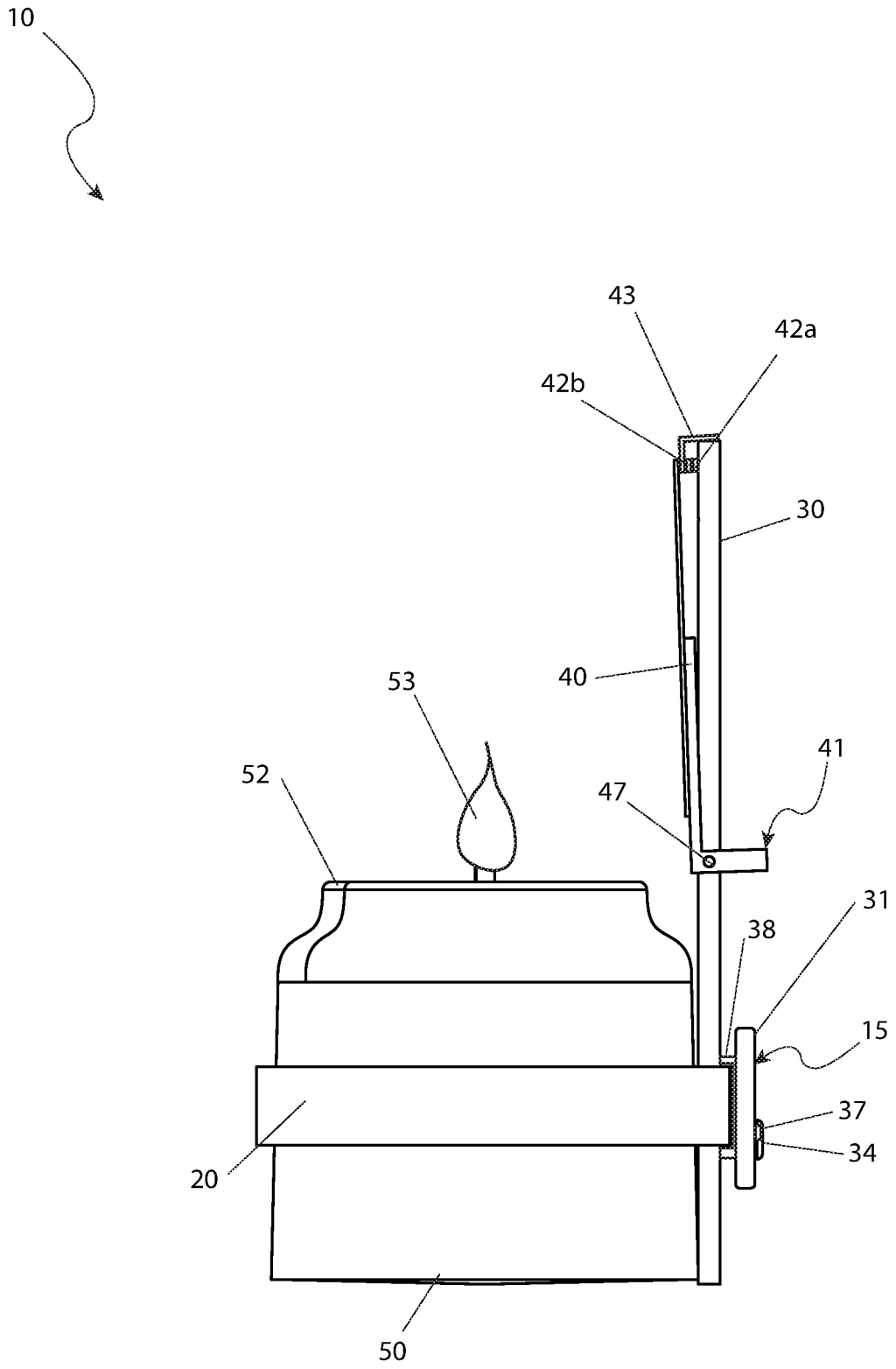
FIG. 4 is an environmental side elevation view of the automatic candle snuffer 10, according to the preferred embodiment of the present invention.
Figure 5:
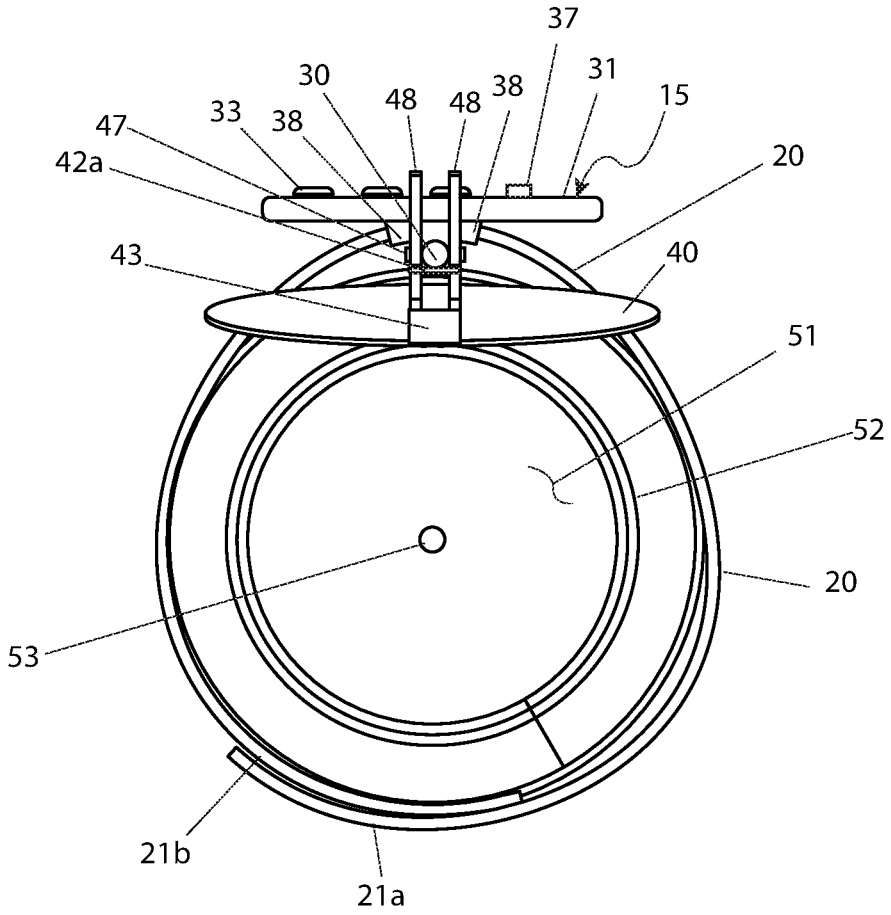
FIG. 5 is an environmental top plan view of the automatic candle snuffer 10, according to the preferred embodiment of the present invention.
Figure 6:
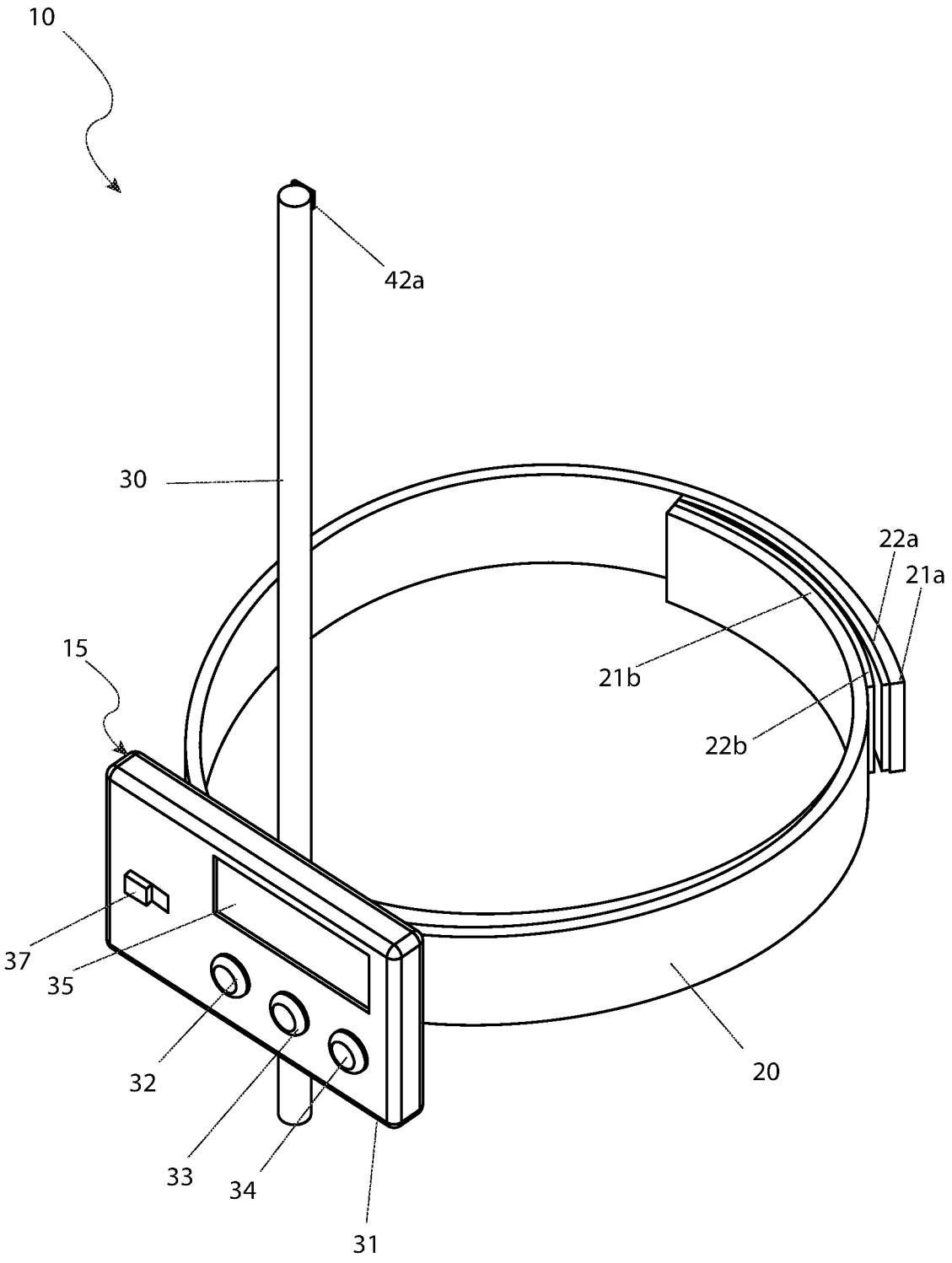
FIG. 6 is a perspective front view of the strap 20, post 30, and timer 31 portion of the automatic candle snuffer 10, according to the preferred embodiment of the present invention.
Figure 7:
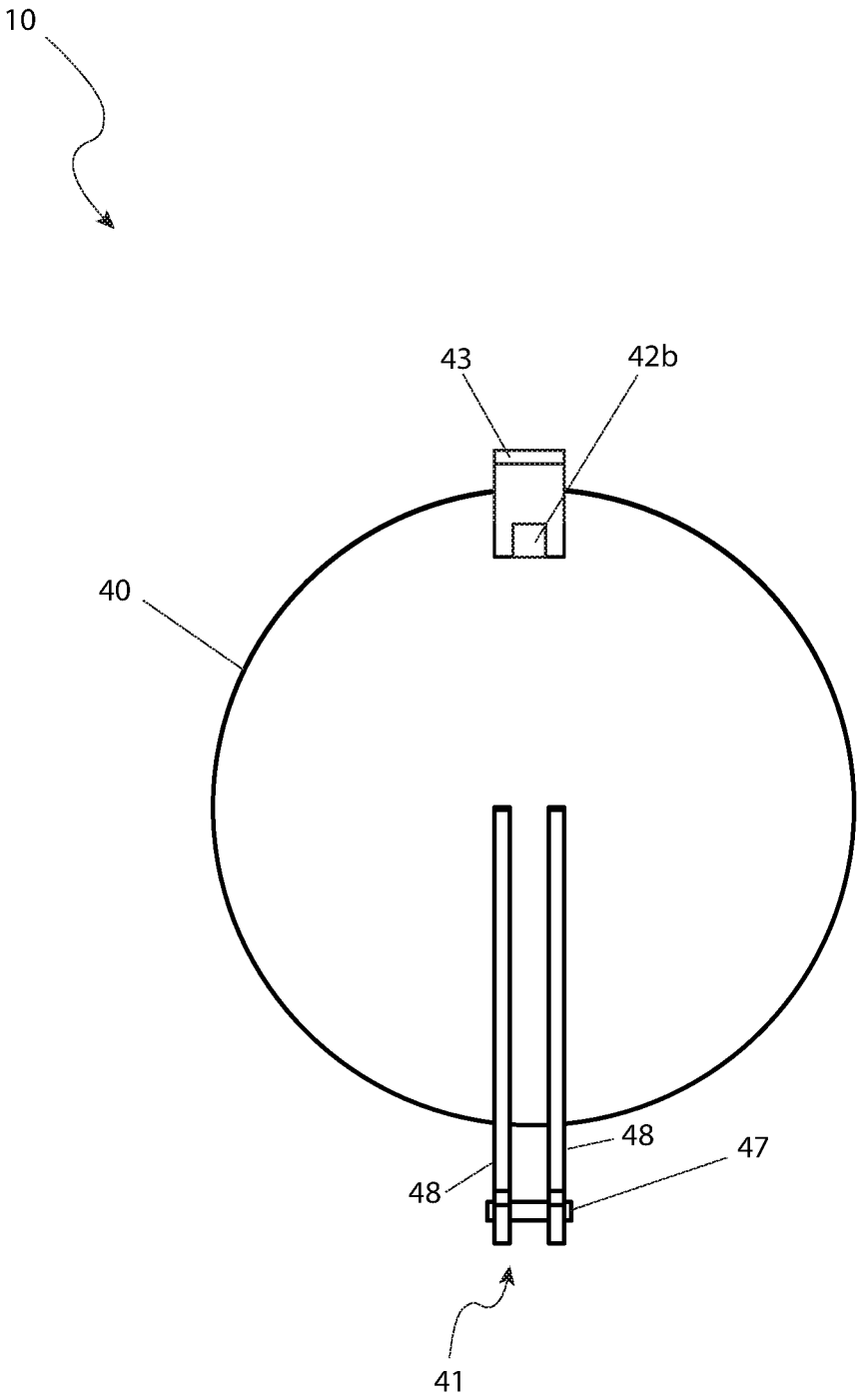
FIG. 7 is a rear elevation view of the plate 40 portion of the automatic candle snuffer 10, according to the preferred embodiment of the present invention.
Figure 8:
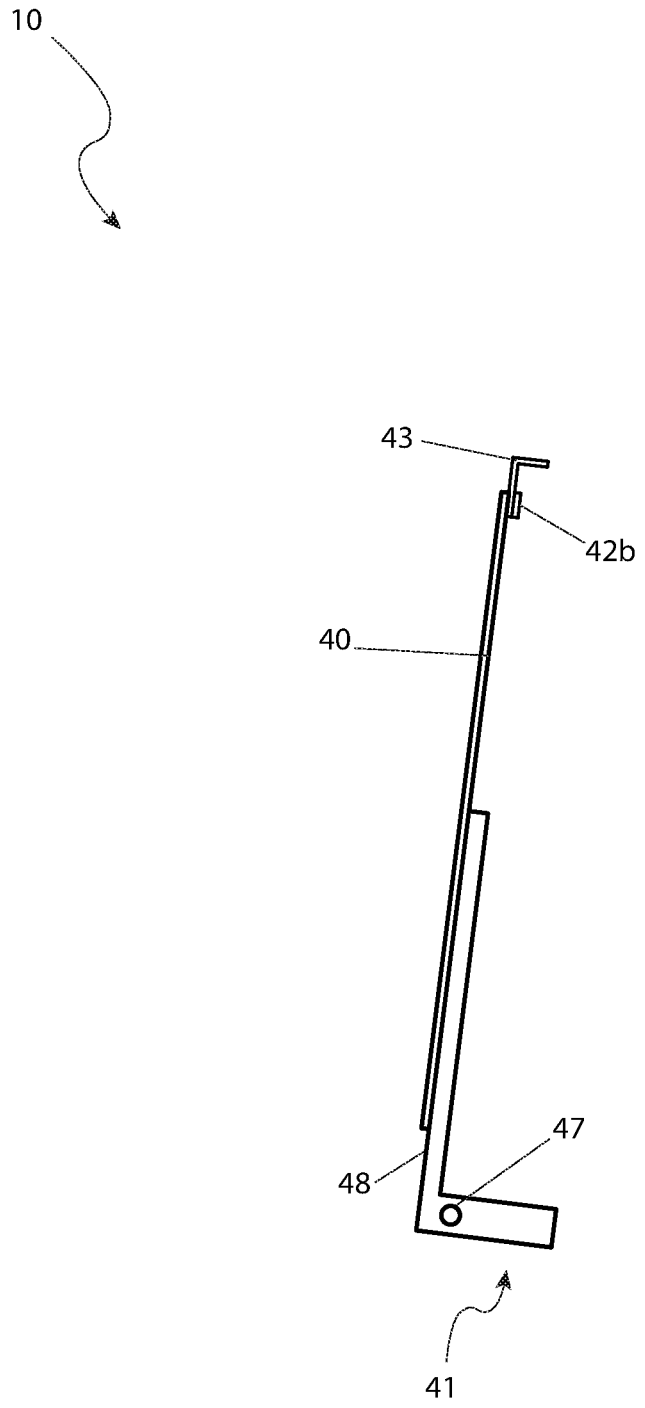
FIG. 8 is a side elevation view of the plate 40 portion of the automatic candle snuffer 10, according to the preferred embodiment of the present invention.

10 automatic candle snuffer
15 timing device
20 strap
21*a* first strap end
21*b* second strap end
22*a* first fastener
22*b* second fastener
30 post
31 timer housing
32 first switch
33 second switch
34 third switch
35 display
36 microprocessor
37 power switch
38 loop
40 plate
41 hinge
42*a* first magnet
42*b* second magnet
42*c* hook
42*d* eyelet
43 offset bracket
44 striker
45 spring
47 pin
48 hinge arm
50 container
51 candle
52 opening
53 flame
60 solenoid
61 battery
62 cord

DESCRIPTION OF THE PREFERRED EMBODIMENTS

Figure 9:
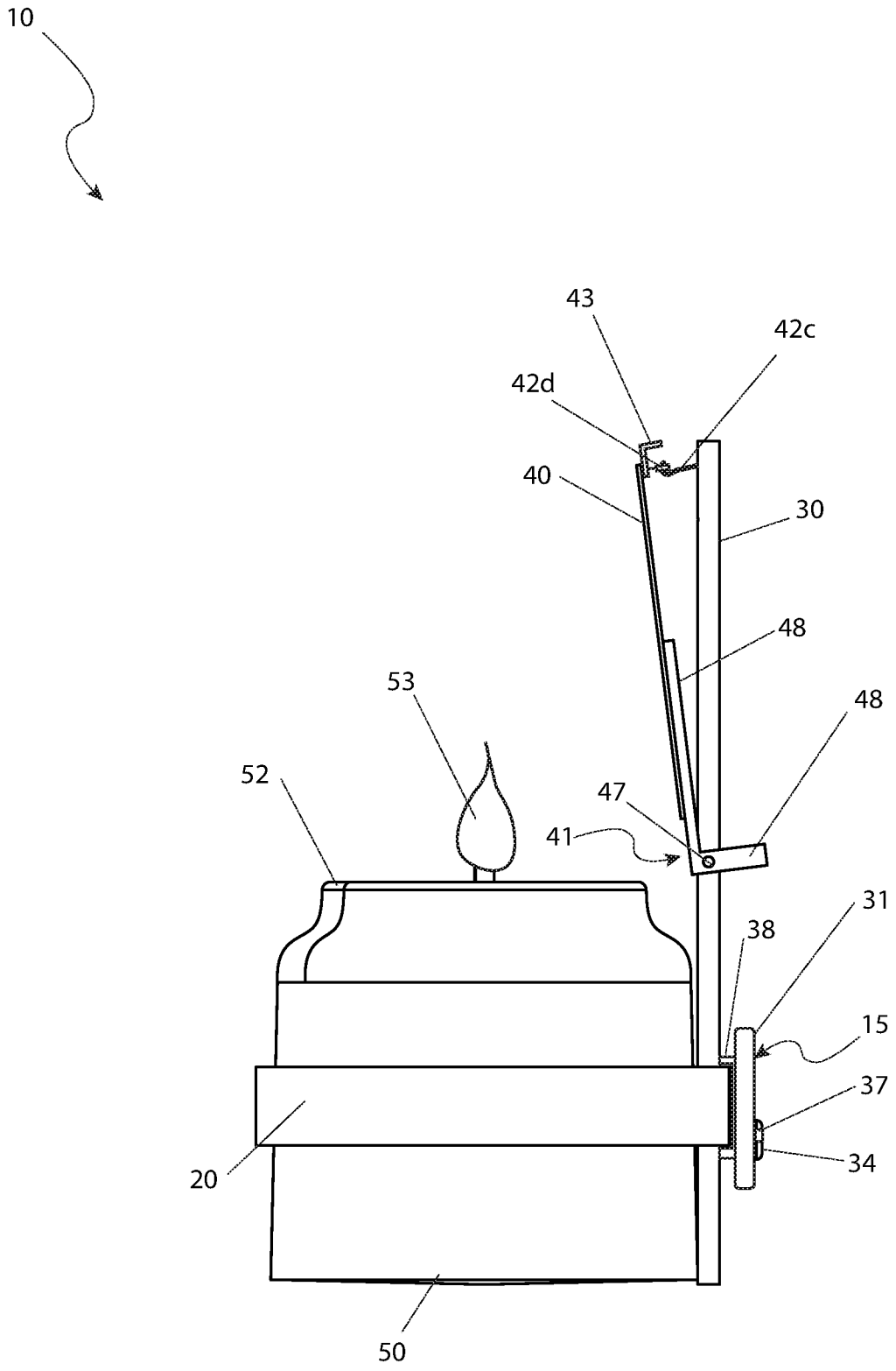
FIG. 9 is an environmental side elevation view of the automatic candle snuffer 10, according to an alternate embodiment of the present invention.
Figure 10:
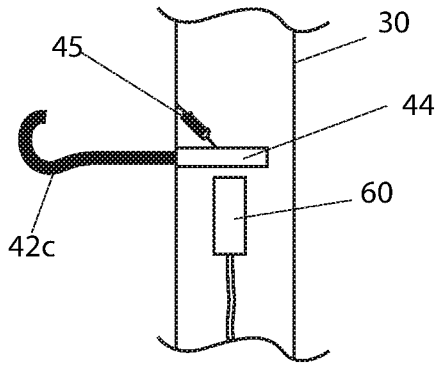
FIG. 10 is a side elevation cut away view of the post 30 along the line I-I (see of FIG. 9), according to the alternate embodiment of the present invention.
Figure 11:
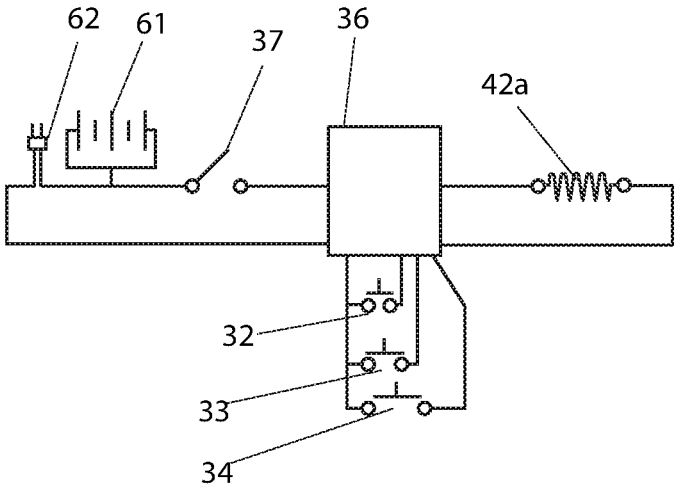
FIG. 11 is an electrical schematic of the automatic candle snuffer 10, according to the preferred embodiment of the present invention; and, FIG. 12 is an electrical schematic of the automatic candle snuffer 10, according to the alternate embodiment of the present invention.
Figure 12:
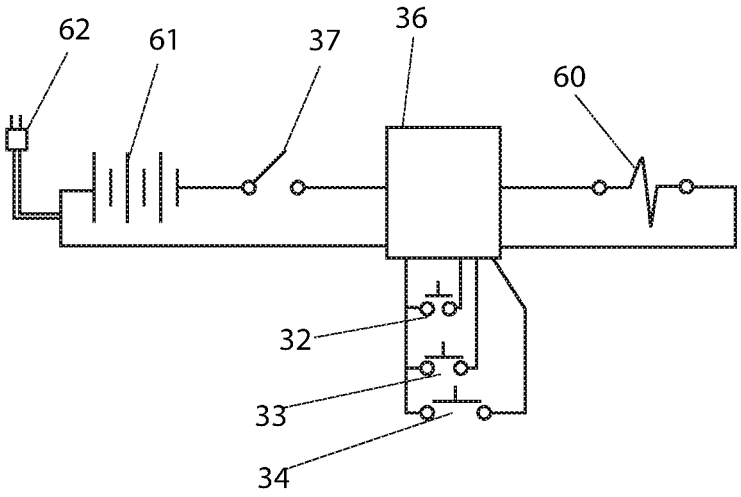

The best mode for carrying out the invention is presented in terms of its preferred embodiment, herein depicted within FIGS. 1 through 8 and 11, and in an alternate embodiment depicted within FIGS. 9, 10, and 12. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

Referring now to FIGS. 1 through 8 and 11, a perspective environmental view of the automatic candle snuffer 10, according to the preferred embodiment of the present invention is disclosed. The automatic candle snuffer 10 (herein described as the "device") includes a timing device 15 affixed or otherwise attached to a strap 20 that is capable of adjustable and removable attachment about a perimeter of a container 50 of a candle 51. The timing device 15 is in operable communication with a plate 40, located on a post 30 that is affixed or otherwise attached to the timing device 15 or strap 20. Upon selective activation of the timing device 15, the timing device 15 is capable of releasing the plate 40 to extinguish the flame 53 of the candle 51 without entering the opening 52 of the container 50.

The strap 20 is envisioned to be an elongated generally linear unitary construction of a fabric or synthetic material, having a strap first end 21*a* and a strap second end 21*b*. The strap 20 has a length enabling covering over a perimeter of a conventional container 50 for a candle 51 and partially extending past the perimeter and enabling partial coverage over itself. Typically, either the strap first end 21*a* or strap second end 21*b* can overlap over the opposing strap first end 21*a* or strap second end 21*b*. A first fastener 22*a* is located at the strap first end 21*a* and a second fastener 22*b* is located at the strap second end 21*b*. The fasteners 22*a*, 22*b* correspondingly mate with each other in order to removably secure the strap 20 to the container 50. It is part of the scope of the invention to enable the strap 20 to removably attach to any conventional sizes or shapes of container 50, whether cylindrical, rectangular, or any other shape. The strap 20 and fasteners 22*a*, 22*b* can be Velcro® in a preferred embodiment. Any number of sizes, colors, or decorative indicia can be used with or on the strap 20.

The timing device 15 is affixed to a first side of the strap 20, preferably in a central location. The timing device 15 includes a timer housing 31, a plurality of user accessible interface switches 32, 33, 34, 37, a display 35, and a microprocessor 36 in electrical communication with the switches 32, 33, 34, 37, and the display 36. The timer housing 31 can be a minimally thick structure with rounded corners and affixed or attached to the strap 20 with adhesive or mechanical fasteners and manufactured out of a resilient and lightweight material, such as a plastic. In a preferred embodiment, the rear of the timer housing 31 has at least one (1) loop 38 affixed or attached thereto, or alternately be an integral part thereof. The loop 38 has an internal passage rendered longitudinal and parallel with the width of the timer housing 31 and container 50, such that the strap 20 can pass therethrough with minimal clearance. Such a loop 38 can also be made of a material than can be deformable enough to enable the strap 20 to pass therethrough and rebound to provide a secure frictional fit between the loop 38, and hence the timing device 15, to the strap 20. The loop 38 is preferably centrally located so as to provide weighted balance for the timing device 15 on the strap 20.

The post 30 is a hollow member generally of the same material as the timing device 15 or of a metallic nature capable of withstanding the thermal variants associated with the flame 53 of the candle 51. The post 30 has an upper end and a lower end. The post 30 in one (1) embodiment is a separate member from the timing device 15 and is "sandwiched" between the container 50 and loop 38 when the device 10 is installed on the container 50. In such an embodiment, wiring from the timing device 15 is routed within an aperture of the post 30, or most likely, through the bottom of the post 30 at the lower end. In a secondary embodiment where the post 30 is an integral part of the timing device 15, the wiring can also be routed through an aperture or the bottom of the post 30 at the lower end, or through an internal structure such as the loop 38. In this particular embodiment, the post 30 can be vertically adjustable relative to the timing device 15. In either embodiment, the post 30 is a vertical element and preferably oriented perpendicular to the timer housing 31.

The plate 40 is a thin generally heat-resistant material sized and shaped so as to cover the opening 52 of the container 50. As such, it can generally take on the shape of the opening 52, such as circular or rectangular. The size of the plate 40 can enable it to partially or fully cover the opening 52 thereby adequately extinguishing the flame 53. The plate 40 thusly has a first side that contacts the container 50 about the opening 52, a second side, a first end attached to the post 30 with a hinge 41, and a second end removably attached to the upper end of the post 30. Any number of sizes, colors, or decorative indicia can be used with or on the plate 40.

The plate 40 is hingedly attached to the post 30 with the hinge 41 superjacent to the timing device 15. The post 30 is either sized, oriented, or selectively adjusted to ensure that the plate 40 covers the opening 52 of the container 50 so as to adequately extinguish the flame 53. This can also be accomplished by attaching the strap 20 of the device 10 at the proper location on the container 50 to accomplish this. The hinge 41 includes a pin 47 routed through a pair of hinge arms 48. The hinge arms 48 bracket each side of the post 30 and are generally "L"-shaped, comprising a first portion and a second portion; the first portion is shorter in length than the second portion. The second portion of each hinge arm 48 is affixed or removably attached to a second side of the plate 40, opposite the first side, and at the first end of the plate 40. Each second portion of the hinge arm 48 is affixed to the second side at a length enabling the plate 40 to at least partially cover the opening 52 of the container 50 and/or contact the container 50 about the opening 52 to adequately extinguish the flame 53. The pin 47 and hinge arms 48 of the hinge 41 are disposed in such a way as to slightly bias the plate 40 toward the opening 52 of the container 50. In embodiments where the plate 40 is removably attached to the hinge arms 48, different decorative or sizes or shapes of plates 40 may be interchanged, based on user preference or for reasons due to size of container 50 or opening 52.

The second end of the plate 40, at the second side, is removably attached to the upper end of the post 30. In a first embodiment, the upper end of the post 30 has a first magnet 42*a* in electrical communication with the microprocessor 36 through electrical wiring (not shown) within the post 30. Upon activation of the timing device 15, the microprocessor 36 momentarily ceases supplying electricity to the first magnet 42*a*, then re-energizes the first magnet 42*a*. In one such an embodiment, power must be constantly supplied to the first magnet 42*a* through the timing device 15. This can ideally be accomplished with the use of a battery 61 (although other power methods may be utilized). A second magnet 42*b* resides on an offset bracket 43 on the second end of the plate 40 and is magnetically connected to the first magnet 42*a* in a normal operation when the timing device 15 has power supplied to it. The offset bracket 43 is generally "L"-shaped, with a first leg attached to the plate 40 and the second leg extending away therefrom, and towards the post 30. The first leg of the offset bracket 43 has the second magnet 42*b* affixed or otherwise bonded thereto. The second leg of the offset bracket 43 effectively covers over the terminal upper end of the post 30 and protects the magnetic connection between the first magnet 42*a* and second magnet 42*b*. When the timing device 15 is activated and electricity to the first magnet 42*a* is momentarily ceased, the magnetic connection between the first magnet 42*a* and second magnet 42*b* is broken and the plate 40 falls due to gravity along an arcuate path relative to the post 30 via the hinge 41 to at least partially cover the opening 52 of the container 50 to extinguish the flame 53 of the candle 51.

Referring now to FIGS. 9, 10 and 12, the second end of the post 30 has a hook 42*c* extending away therefrom, and in the direction of the plate 40. The hook 42*c* extends inward through the post 30 and terminates in a striker 44, which can be a planar element in the same plane as the longitudinal arm of the hook 42*c*. The striker 44 resides immediately superjacent to the solenoid 60 and is biased to render the plate perpendicular to a vertical bisecting centerline on the post 30 and solenoid 60 via spring 45. The solenoid 60, when activated, momentarily travels vertically to deflect the striker 44 against the spring 45, thereby forcing the striker 44 upward and the hook 42*c* downward, and then reseats itself. An eyelet 42*d* resides on the offset bracket 43 on the second end of the plate 40 and is mechanically coupled to the hook 42*c* prior to use. As in the preferred version, the offset bracket 43 is generally "L"-shaped, with a first leg attached to the plate 40 and the second leg extending away therefrom, and towards the post 30. The first leg of the offset bracket 43 has a stem of the eyelet 42*d* affixed or otherwise bonded thereto, such that the eye portion located at the opposing end of the stem is in a horizontal plane such that the open top and bottom is vertically accessible by the hook 42*c*. The second leg of the offset bracket 43 effectively covers over the terminal upper end of the post 30 and protects the mechanical coupling of the hook 42*c* and eyelet 42*d*. When the timing device 15 is activated and electricity to the solenoid 60 is achieved, the hook 42*c* is displaced downward from the eyelet 42*c* and the plate 40 falls due to gravity along an arcuate path relative to the post 30 via the hinge 41 to at least partially cover the opening 52 of the container 50 to extinguish the flame 53 of the candle 51. When the solenoid 60 reseats itself, the striker 44 and hook 42*c* are oriented in their initial position to enable a user to reseat the hook 42*c* within the eyelet 42*d*. A benefit of this alternate embodiment is that the solenoid 60 does not have to be continuously supplied with power and can run on conventional batteries 61.

Incorporated with the timing device 10 are user interfaces enabling selective control of the device 10. A power switch 37 is located on an exterior facing surface of the timer housing 31 and is in electrical communication between the microprocessor 36 and the battery 61 or power cord 62, depending on the embodiment. A plurality of switches 32, 33, 34 are located adjacent the power switch 37 and are in electrical communication with the microprocessor 36. Although three (3) switches are illustrated and described herein, it is appreciated that any number of switches to perform any number of timer or other related functions fall under the scope of the overall invention. In at least one (1) embodiment, a first switch 32 can provide incremental numerical time functions, a second switch 33 can provide decremental numerical time functions, and a third switch 34 can provide timer setting functions. Multiple subsequent activations or concurrent activations of any or all of the switches 32, 33, 34 can provide other timer functions, such as cessation of the timer, enablement of an audio indication of timer activation, etc. The display 35, also in electrical communication with the microprocessor 36 and provided directly on the timer housing 31 adjacent to and preferably on the same face as the switches 32, 33, 34, 37, provides indication of power supply, timer setting, and timer incremental or decremental movement, etc. The timer itself is programmed within the microprocessor 36 and function as a clock such that a specific timer can be set, or merely a countdown timer, where a period of time until activation can be set. All switches 32, 33, 34, 37 and the display 35 are in an easily accessible and viewable location.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A candle snuffer comprising:

a strap having a strap first end and a strap second end;

a first fastener secured to said strap first end;

a second fastener secured to said strap second end;

a timing device having a power source secured to said strap between said strap first end and said strap second end;

a post having an interior void comprising:

a post first end;

a post middle portion; and, a post second end opposite said post first end;

wherein said post first end is perpendicularly secured behind said timing device;

a plate comprising:

a plate first end; and, a plate second end opposite said plate first end;

wherein said plate first end is hingedly secured to said post middle portion; and, wherein said plate second end is temporarily secured to said post second end by a hook which is moveable secured partially within said post second end and an eyelet secured to said plate second end, a distal end of said hook configured to rest within said eyelet;

wherein said first fastener and said second fastener are configured to removably secure said candle snuffer about a circumference of a receptacle having a topside opening;

wherein said timing device is in electrical communication with said hook;

wherein said timing device is configured to selectably designate a period of time, upon expiration of which, said timing device releases said hook from said eyelet;

wherein upon release of said hook from said eyelet, said plate falls from a vertical position to a horizontal position;

wherein when in said horizontal position, said plate covers said topside opening of said receptacle; and, wherein a burning candle contained within said receptacle is extinguished when said plate is in said horizontal position.

2. The snuffer of claim 1, wherein said first fastener and said second fastener comprise hook and loop material.

3. The snuffer of claim 1, wherein said timing device comprises a timing device housing defining an interior containing a programable microprocessor in communication with said power source within said interior.

4. The snuffer of claim 3, wherein said timing device further comprises a plurality of switches disposed upon an outer surface of said timing device housing in electrical communication with said microprocessor.

5. The snuffer of claim 4, wherein said snuffer further comprises:

a striker plate; and, a spring;

wherein said striker plate is secured to said portion of said hook residing within said post;

wherein said spring is secured to said striker plate;

wherein when said spring is in a relaxed state said hook is disengaged from said eyelet;

wherein when a solenoid adjacent said striker plate and within said post is activated, said solenoid secures said striker plate in a position which keeps said spring in taut state; and, wherein when in said taut state said hook is capable of engaging said eyelet.

6. The snuffer of claim 5, wherein said plurality of switches permit a user to set a start time and a stop time relating to electrification of said solenoid.

7. The snuffer of claim 6, wherein said plate further comprises:

a pair of hinge arms, and, a pin;

wherein each said hinge arm is secured to said plate at a respective hinge arm first end and around said post at a respective hinge arm second end; and, wherein said pin is secured through each said hinge arm second end and said post.

8. The snuffer of claim 1, further comprising an offset bracket.

9. The snuffer of claim 8, wherein said offset bracket is L-shaped having a first bracket arm and a second bracket arm perpendicular to said first bracket arm.

10. The snuffer of claim 9, wherein said first bracket arm is secured behind said eyelet and said second bracket arm covers said eyelet and said hook when said plate is in said vertical position.

* * * * *